US007848532B2

(12) United States Patent
Akino

(10) Patent No.: US 7,848,532 B2
(45) Date of Patent: Dec. 7, 2010

(54) CONDENSER MICROPHONE

(75) Inventor: Hiroshi Akino, Machida (JP)

(73) Assignee: Kabushiki Kaisha Audio-Technica, Machida-Shi, Tokyo (JP)

( * ) Notice: Subject to any disclaimer, the term of this patent is extended or adjusted under 35 U.S.C. 154(b) by 1209 days.

(21) Appl. No.: 11/453,939

(22) Filed: Jun. 16, 2006

(65) Prior Publication Data

US 2006/0285703 A1 Dec. 21, 2006

(30) Foreign Application Priority Data

Jun. 17, 2005 (JP) ..... 2005-177542

(51) Int. Cl.
*H04R 3/00* (2006.01)

(52) U.S. Cl. ..... 381/113; 381/122; 381/111

(58) Field of Classification Search ..... 380/150, 380/369, 122, 355, 92, 91, 120, 156, 111–115
See application file for complete search history.

(56) References Cited

U.S. PATENT DOCUMENTS 4,567,608 A * 1/1986 Watson et al. ..... 381/122
6,549,632 B1 * 4/2003 Akino et al. ..... 381/174
2002/0186855 A1 * 12/2002 Akino et al. ..... 381/111

FOREIGN PATENT DOCUMENTS

JP H03-201608 A 9/1991
JP 6-52300 * 7/1994
JP 2001-111361 A 4/2001

* cited by examiner

*Primary Examiner*—Vivian Chin
*Assistant Examiner*—Lun-See Lao
(74) *Attorney, Agent, or Firm*—Manabu Kanesaka

(57) ABSTRACT

To operate from any of phantom power sources of 12 V, 24 V and 48 V and secure a maximum output level according to each of the power sources. A condenser microphone including a microphone unit MU containing a diaphragm and a fixed pole, an FET Q1 of a built-in bias circuit type for operating as an impedance converter of the microphone unit MU and an output transformer TRS connected to a phantom power source with a midpoint of a primary winding of the output transformer TRS connected to a drain of the FET Q1 via a constant current diode D2, and a transistor Q2 of an emitter follower for current amplification connected between a source of the FET Q1 and a secondary winding of the output transformer TRS, wherein a diode D3 is connected between the source of the FET Q1 and a base of the transistor Q2 to have an anode thereof on the source side of the FET Q1 so as to provide forward voltage generated by the diode D3 to the base of the transistor Q2.

10 Claims, 2 Drawing Sheets

CONDENSER MICROPHONE

TECHNICAL FIELD

The present invention relates to a condenser microphone operating from a phantom power source, and in particular, to the condenser microphone capable of operating from any of the phantom power sources of 12 V, 24 V and 48 V and securing a maximum output level according to each of the power sources.

BACKGROUND ART

A condenser microphone includes a microphone unit configuring a kind of condenser having a diaphragm and a fixed pole placed oppositely via a spacer. As the microphone unit has very high output impedance, it requires an impedance converter for converting the output impedance to low impedance. An FET (Field-Effect Transistor) is normally used as the impedance converter.

The FETs applied to the impedance converter of the microphone unit can be roughly divided into the FET having no bias circuit including diodes and resistance elements built therein (2SK330 for instance) and the FET having the bias circuit built therein (2SK660 for instance).

Of these, the FET having no bias circuit built therein has an advantage of being able to render Idss (a drain current value when voltage between a gate and a source is 0) variable by selecting the bias circuit. However, it additionally requires the bias circuit to be externally mounted. Therefore, its unit size becomes large if applied to a small microphone unit such as a tiepin-shaped condenser microphone.

For that reason, the FET having the bias circuit built therein is preferably adopted in many cases. However, this kind of FET has fixed bias voltage and is unable to change the Idss. To secure maximum output voltage by making up for this, the circuit shown in FIG. 3 is conventionally adopted. This circuit operates from a phantom power source.

As shown in FIG. 3, the condenser microphone includes as its basic configuration a microphone unit MU, an FET Q1 as the impedance converter and an output transformer TRS connected to the phantom power source not shown via an output connector CN.

Although not shown, the microphone unit MU has a diaphragm and a fixed pole placed oppositely via a spacer therein, where the fixed pole is normally connected to a gate of the FET Q1. In the case of an electret type, an electret member is applied to one of the diaphragm and fixed pole.

The FET Q1 is a built-in bias circuit type, and includes the bias circuit combining two diodes and one resistance element between the gate and source thereof. The output connector CN includes three terminal pins of a terminal pin 1 for grounding, a terminal pin 2 of a hot side of a signal and a terminal pin 3 of a cold side of a signal, where a primary winding of the output transformer TRS is connected between the terminal pin 2 and the terminal pin 3. The terminal pin 1 is connected to the diaphragm side of the microphone unit MU by rendering an unshown unit housing as a grounding line L3 for instance.

A midpoint tap is provided to the primary winding of the output transformer TRS, and is connected to a drain of the FET Q1 via a current supply line L1 including a constant current diode D2. The source of the FET Q1 is connected to one end of a secondary winding of the output transformer TRS via an output line L2 including a resistance element R2 for output and an electrolytic capacitor C3 for AC coupling. The other end of the secondary winding is connected to the grounding line L3.

A diode D1 for keeping the voltage between the drain and the source of the FET Q1 constant and an electrolytic capacitor C2 for AC coupling are connected in parallel between the current supply line L1 and the output line L2. To secure the maximum output voltage by making up for the fixed bias voltage of the FET Q1, a transistor Q2 of an emitter follower as a current amplifier is connected between the output line L2 and the grounding line L3.

In this example, the transistor Q2 is a PNP type, and its base is connected to the source of the FET Q1 via an electrolytic capacitor C1 for AC coupling. Voltage dividing resistance elements R1 and R3 for providing predetermined base voltage to the transistor Q2 are connected between an emitter and a collector (grounding line L3) of the transistor Q2.

During operation of the microphone, a current of 2 mA, for instance, is supplied to the drain of the FET Q1 from the constant current diode D2 by means of power feeding from the phantom power source, and the voltage between the drain and the source is kept at 0.7 V or so by the diode D1.

A voice signal modulated by the output voltage of the microphone unit MU applied to the gate is outputted from the source of the FET Q1, is amplified by the transistor Q2 and outputted to an external receiver via the secondary winding of the output transformer TRS and the terminal pin 1 for grounding.

According to EIAJ RC-8162A (electric supply method of a microphone), three kinds of 12 V, 24 V and 48 V are prescribed as to the phantom power source for the condenser microphone. If the circuit is designed in favor of 11 V to address this in the case of operating the condenser microphone at voltage between 11 to 52 V for instance, the maximum output voltage when using 24 V or 48 V is kept low.

In comparison, if the circuit is designed to operate at 48 V, the maximum output voltage can be high. However, the maximum output voltage becomes extremely low at 24 V, and it no longer operates when connected to the phantom power source of 12 V.

FIG. 4 shows a graph of an input level (dBV) versus a distortion factor (THD+N level) (the distortion factor of the vertical axis is a logarithmic scale) in the case of designing a conventional condenser microphone having a circuit configuration of FIG. 3 to operate at 48 V.

In the case where the distortion factor of 1% is an upper limit of a permissible level of sound quality, a maximum output level on operating at 48 V is approximately 15.3 dBV. In the case where sensitivity S is −40 dBV/Pa, a maximum permissible input sound pressure level is approximately 149.3 dBSPL.

Next, if operated from the phantom power source of 24 V, the maximum output level is approximately 1.8 dBV. In the case where the sensitivity S is −40 dBV/Pa, the maximum permissible input sound pressure level is approximately 135.8 dBSPL.

In the case of further reducing the voltage and using the phantom power source of 12 V, it does not operate as the microphone. A cause thereof is that a collector-emitter voltage $V_{CE}$ of the transistor Q2 for current amplification is uniquely decided by resistance values of the voltage dividing resistance elements R1 and R3.

SUMMARY OF THE INVENTION

Therefore, an object of the present invention is to provide a condenser microphone capable of operating from any of phantom power sources of 12 V, 24 V and 48 V and securing a maximum output level according to each of the power sources.

To achieve the object, the present invention is a condenser microphone including a microphone unit containing a diaphragm and a fixed pole, an FET of a built-in bias circuit type for operating as an impedance converter of the microphone unit and an output transformer connected to a phantom power source with a midpoint of a primary winding of the output transformer connected to a drain of the FET via a constant current diode, and a transistor of an emitter follower for current amplification connected between a source of the FET and a secondary winding of the output transformer, wherein a diode is connected between the source of the FET and a base of the transistor to have an anode thereof on the source side of the FET so as to provide forward voltage generated by the diode to the base of the transistor.

According to the present invention, the forward voltage generated by the diode is provided to the base of the transistor of the emitter follower (current amplifier) connected to the source side of the FET of the built-in bias circuit type (FET having fixed bias voltage and including the built-in bias circuit combining the diodes and a resistance element) so as to operate stably even if power supply voltage fluctuates (changes in the voltage are absorbed by the constant current diode. Therefore, the condenser microphone can operate from any of the phantom power sources of 12 V, 24 V and 48 V and secure the maximum output level according to each of the power sources. Furthermore, the number of components is the same as before so that it requires no cost increase.

DETAILED DESCRIPTION

Figure 1:
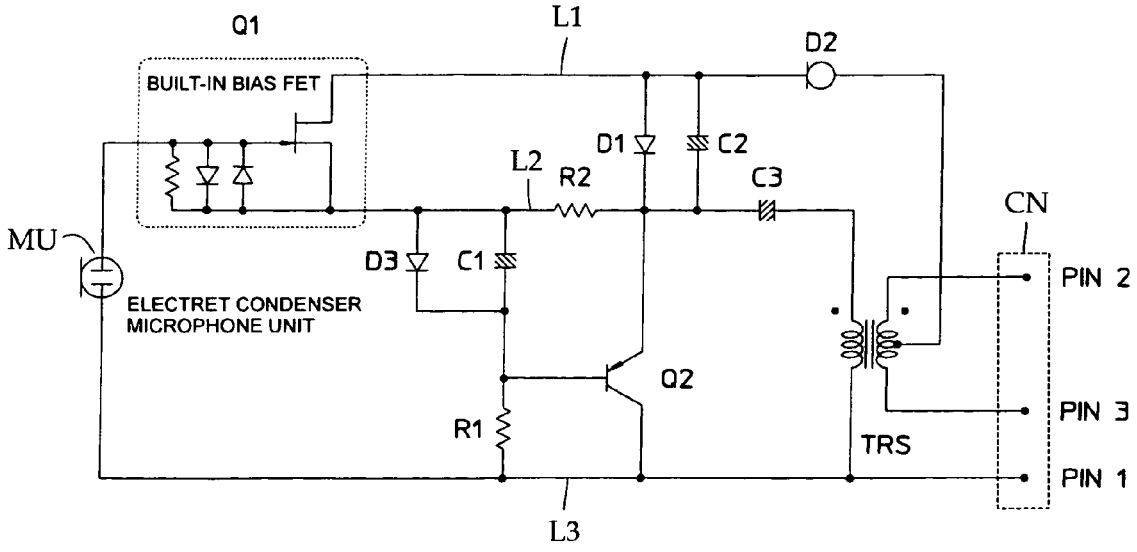
FIG. 1 is a circuit diagram of a condenser microphone according to the present invention.
Figure 2:
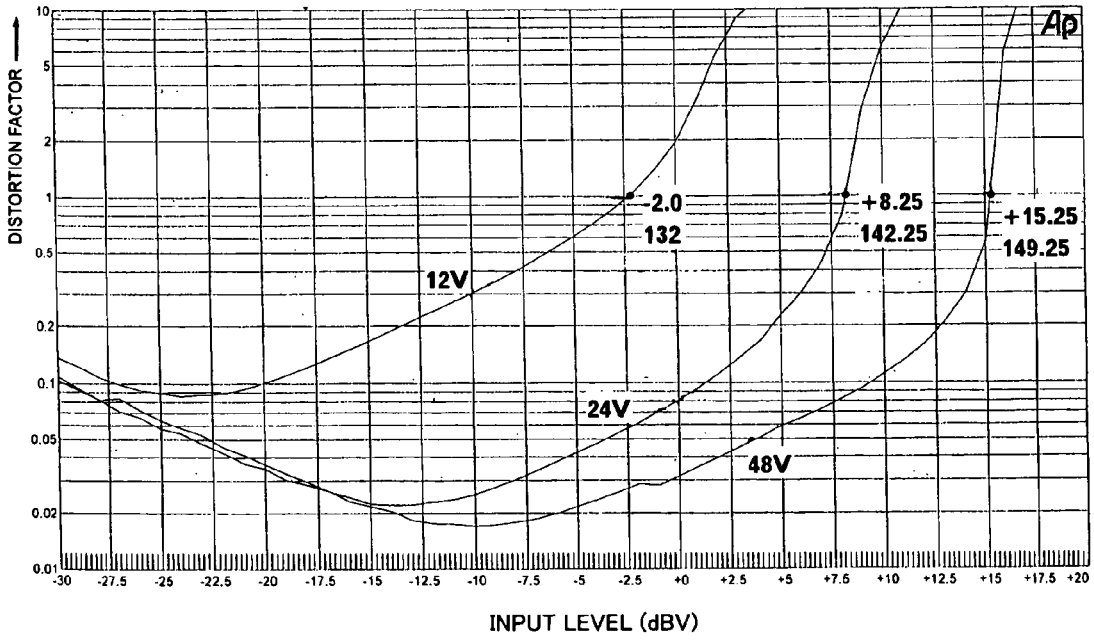
FIG. 2 is a graph showing an input level (dBV) versus a distortion factor (THD+N level) measured on the condenser microphone of the present invention.
Figure 4:
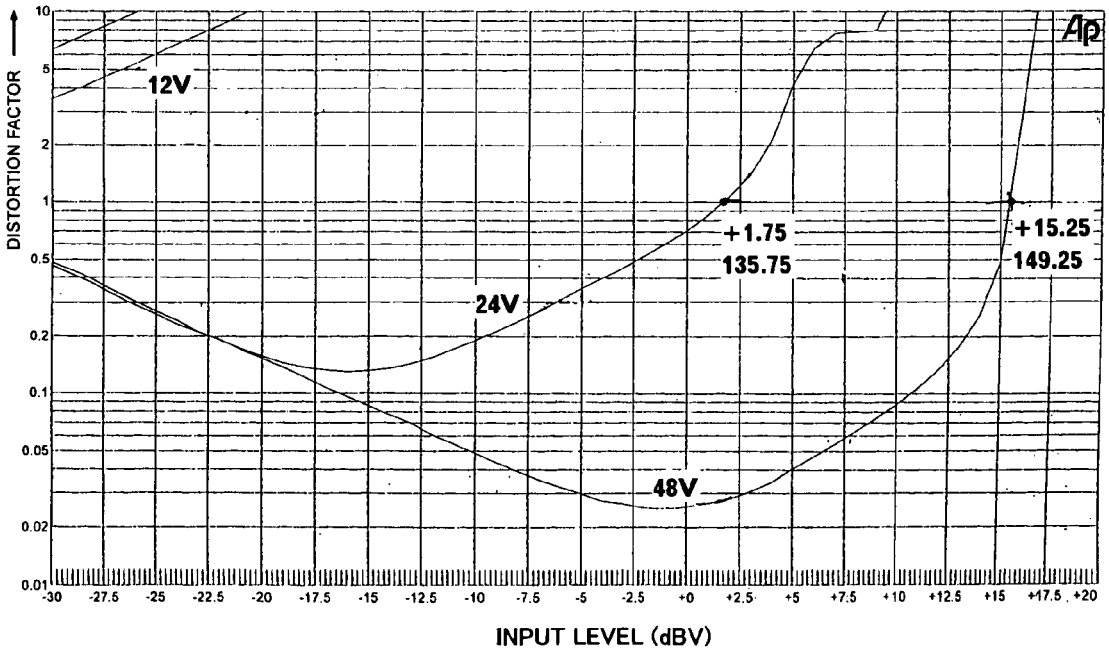
FIG. 4 PRIOR ART
FIG. 4 is a graph showing the input level (dBV) versus the distortion factor (THD+N level) measured on the conventional condenser microphone.

Next, an embodiment of the present invention will be described by referring to FIGS. 1 and 2. However, the present invention is not limited thereto. FIG. 1 is a circuit diagram of a condenser microphone according to the present invention, and FIG. 2 is a graph similar to FIG. 4 showing an input level (dBV) versus a distortion factor (THD+N level) measured on the condenser microphone of the present invention.

Figure 3:
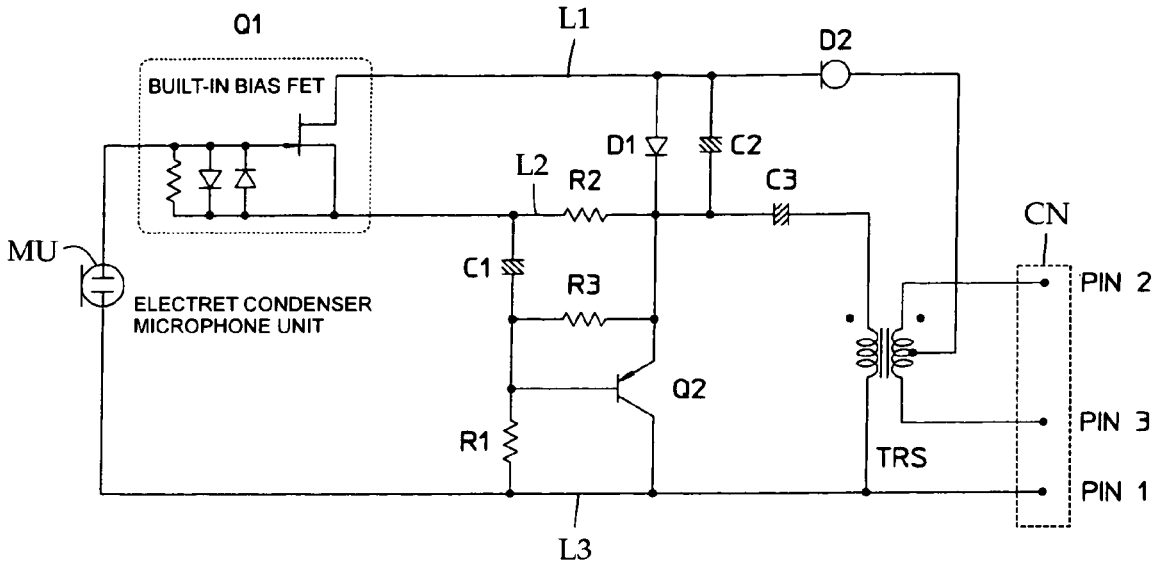
FIG. 3 PRIOR ART
FIG. 3 is a circuit diagram of a conventional condenser microphone.

As shown in FIG. 1, the condenser microphone includes as its basic configuration a microphone unit MU, an FET Q1 as an impedance converter and an output transformer TRS connected to a phantom power source not shown via an output connector CN. These may be the same as the conventional example described in FIG. 3.

To be more specific, the microphone unit MU has a diaphragm and a fixed pole which are not shown placed oppositely via a spacer therein, where the fixed pole is normally connected to a gate of the FET Q1. The microphone unit MU may also be an electret type having an electret member applied to one of the diaphragm and fixed pole.

The FET Q1 is a built-in bias circuit type and includes the bias circuit combining two diodes and one resistance element between the gate and source thereof, and bias voltage is thereby fixed.

The output connector CN includes three terminal pins of a terminal pin 1 for grounding, a terminal pin 2 of a hot side of a signal and a terminal pin 3 of a cold side of a signal, where the connector prescribed in EIAJ RC-5236 "Latch lock circular connector for audio equipment" is preferably used.

A primary winding of the output transformer TRS is connected between the terminal pin 2 and the terminal pin 3 of the output connector CN. The terminal pin 1 is connected to the diaphragm side of the microphone unit MU by rendering an unshown unit housing as a grounding line L3 for instance.

A midpoint tap is provided to the primary winding of the output transformer TRS, and is connected to a drain of the FET Q1 via a current supply line L1 including a constant current diode D2. A current of 2 mA, for instance, is supplied to the drain of the FET Q1 from the constant current diode D2.

The source of the FET Q1 is connected to one end of a secondary winding of the output transformer TRS via an output line L2 including a resistance element R2 for output and an electrolytic capacitor C3 for AC coupling. The other end of the secondary winding is connected to the grounding line L3.

A diode D1 for keeping the voltage between the drain and the source of the FET Q1 constant (0.7 V for instance) and an electrolytic capacitor C2 for AC coupling are connected in parallel between the current supply line L1 and the output line L2.

To secure the maximum output voltage by making up for the fixed bias voltage of the FET Q1, a transistor Q2 of an emitter follower as a current amplifier is connected between the output line L2 and the grounding line L3.

In this example, the transistor Q2 is a PNP type, and its base is connected to the source of the FET Q1 via an electrolytic capacitor C1 for AC coupling. According to the present invention, a diode D3 is connected between the base of the transistor Q2 and the source of the FET Q1 to be in parallel with the electrolytic capacitor C1 for AC coupling.

In this case, the diode D3 is oriented to have an anode thereof on the source side of the FET Q1. Thus, forward voltage generated by the diode D3 (0.65 to 0.7 V for instance) is provided to the base of the transistor Q2.

Thus, according to the present invention, the forward voltage generated by the diode D3 is applied to the base of the transistor Q2 so that the transistor Q2 operates stably as the current amplifier even if power supply voltage fluctuates. Changes in the voltage are absorbed by the constant current diode D2.

With reference to the graph of FIG. 2 showing the input level (dBV) versus the distortion factor (THD+N level) measured on the condenser microphone of the present invention, a maximum output level on operating at 48 V is 15.3 dBV. In the case where sensitivity S is −40 dBV/Pa, a maximum permissible input sound pressure level is 149.3 dBSPL. This is the same maximum output level as in the case of designing it specifically for 48 V described in the conventional example.

If operated at 24 V, the maximum output level is 8.3 dBV. In the case where the sensitivity S is −40 dBV/Pa, the maximum permissible input sound pressure level is 142.3 dBSPL. If operated at 12 V, the maximum output level is −2.0 dBV. In the case where the sensitivity S is −40 dBV/Pa, the maximum permissible input sound pressure level is 132.0 dBSPL.

As is understandable from this, it is possible, according to the present invention, to obtain the condenser microphone capable of operating from any of the phantom power sources of 12 V, 24 V and 48 V and securing the maximum output level according to each of the power sources.

The present application is based on, and claims priority from, Japanese Application Serial Number JP2005-177542, filed Jun. 17, 2005, the disclosure of which is hereby incorporated by reference herein in its entirety.

The invention claimed is:

1. A condenser microphone including a microphone unit containing a diaphragm and a fixed pole, an FET of a built-in bias circuit type for operating as an impedance converter of the microphone unit and an output transformer connected to a phantom power source with a midpoint of a primary winding of the output transformer connected to a drain of the FET via a constant current diode, and a transistor of an emitter follower for current amplification connected between a source of the FET and a secondary winding of the output transformer, wherein a diode is connected between the source of the FET and a base of the transistor to have an anode thereof on the source side of the FET so as to provide forward voltage generated by the diode to the base of the transistor.

2. A condenser microphone as set forth in claim 1, further comprising a bias circuit associated with the FET, the bias circuit comprising a resistor and two diodes arranged in parallel between a gate and a drain of the FET, the diodes being arranged so that the anodes thereof are oriented in opposite directions.

3. A condenser microphone as set forth in claim 1, further comprising a condenser arranged in parallel with the diode so as to be between the source of the FET and the base of the transistor.

4. A condenser microphone comprising:

a microphone unit containing a diaphragm and a fixed pole, an impedance converter comprising a built-in bias circuit comprising an FET, and a resistor and two diodes arranged in parallel between a gate and a drain of the FET, the diodes being arranged so that the anodes thereof are oriented in opposite directions, an output transformer connected to a phantom power source with a midpoint of a primary winding of the output transformer connected to a drain of the FET via a constant current diode, a transistor of an emitter follower for current amplification connected between a source of the FET and a secondary winding of the output transformer, a first diode connected between the source of the FET and a base of the transistor to have an anode thereof connected to the source side of the FET so as to provide forward voltage generated by the diode to the base of the transistor, and a second diode connected between the drain of the FET and an emitter of the transistor so that an anode thereof is connected to the drain of the FET.

5. A condenser microphone as set forth in claim 4, further comprising a first condenser arranged in parallel with the first diode so as to be connected between the source of the FET and the base of the transistor.

6. A condenser microphone as set forth in claim 5, further comprising a second condenser arranged in parallel with the second diode so as to be connected between the drain of the FET and the emitter of transistor.

7. A condenser microphone as set forth in claim 6, further comprising a third condenser arranged between the source of the FET and a secondary coil of the output transformer.

8. A condenser microphone as set forth in claim 5, wherein the first condenser is an electrolytic condenser.

9. A condenser microphone as set forth in claim 6, wherein the second condenser is an electrolytic condenser.

10. A condenser microphone as set forth in claim 7, wherein the third condenser is an electrolytic condenser.

* * * * *